United States Patent [19]

Mathiak et al.

[11] 4,231,846

[45] Nov. 4, 1980

[54] PLUG FOR PROTECTING COKE-OVEN CHAMBER DOORS FROM THE ACTION OF THE INTERNAL TEMPERATURE IN THE OVEN

[75] Inventors: Hans Mathiak, Bönen; Hans Oldengott, Bockum-Hövel, both of Fed. Rep. of Germany

[73] Assignee: Ruhrkohle, AG., Essen, Fed. Rep. of Germany

[21] Appl. No.: 911,237

[22] Filed: May 31, 1978

[30] Foreign Application Priority Data

Jun. 2, 1977 [DE] Fed. Rep. of Germany ..... 2724982

[51] Int. Cl.[2] ..... C10B 25/06; C10B 25/18

[52] U.S. Cl. ..... 202/248; 110/173 R; 202/242

[58] Field of Search ..... 202/242, 248; 110/173 R

[56] References Cited

U.S. PATENT DOCUMENTS

| | | | |
|---|---|---|---|
| 1,072,857 | 9/1913 | Kickert | 202/248 |
| 1,541,016 | 6/1925 | Wertheim et al. | 202/248 |
| 2,183,704 | 12/1939 | Wilputte | 202/248 |
| 2,275,400 | 3/1942 | Koppers | 202/248 |
| 2,283,282 | 5/1942 | Otto | 202/248 X |
| 2,338,675 | 1/1944 | Van Ackeren | 202/248 |
| 2,855,347 | 10/1958 | Cellan-Jones | 202/248 |
| 3,015,614 | 1/1962 | Bowman | 202/248 |
| 3,505,174 | 4/1970 | Peterson et al. | 202/248 |
| 3,527,179 | 9/1970 | Little | 110/173 R |

FOREIGN PATENT DOCUMENTS

| | | | |
|---|---|---|---|
| 982452 | 6/1951 | France | 202/248 |
| 1098518 | 3/1955 | France | 202/248 |

*Primary Examiner*—Joseph Scovronek
*Assistant Examiner*—Roger F. Phillips
*Attorney, Agent, or Firm*—Andrus, Sceales, Starke & Sawall

[57] ABSTRACT

A plug for protecting coke-oven chamber doors from the action of the internal temperature in the oven, which has a plane outside facing away from the door body, and which is built up from a plurality of refractory bricks and can be mounted on the inside of the door body. The bricks have recesses which each penetrate the plug and bricks for receiving bolts which can be screwed into bores in the plug side of the door.

12 Claims, 22 Drawing Figures

Pos. 1

Pos. 1

Pos. 2

Pos. 2

Pos. 3

Pos. 3

Pos. 4

Pos. 5

Pos. 5

Figure 1:
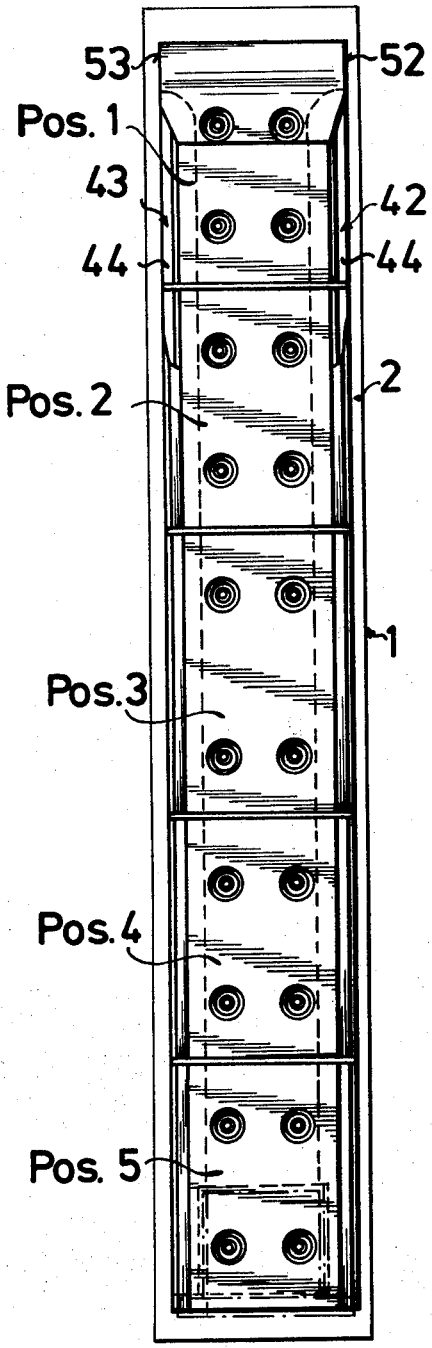

PLUG FOR PROTECTING COKE-OVEN CHAMBER DOORS FROM THE ACTION OF THE INTERNAL TEMPERATURE IN THE OVEN

The invention relates to a plug for protecting coke-oven chamber doors from the action of the internal temperature in the oven, which has a plane outside facing away from the door body and short transitions into its longitudinal sides which have part surfaces converging outwards and inwards, and which is built up from a plurality of refractory bricks and can be mounted on the inside of the door body, which preferably consists of cast iron, together with a back-lining of heat-insulating material with the aid of a plurality of fixing means and which can be supported on a brick-holder which is integral with the door.

These plugs have the object of preventing scaling of the door body, which occurs under the direct action of the oven temperature. The form of the plug, which is described, is intended to ensure that it tightly adjoins the side walls of the chamber, although it is of course necessary that interspaces are present, inter alia for the purpose of heat balance. The back-lining of the plug forms an additional insulation of the door body against excessive heating and heat losses to the outside. Door bodies of cast iron or forged iron permit the door weights to be reduced.

Plugs are known, which are bricked up from refractory bricks and in which a plurality of bricks has to be worked in order to fill the height and the width of the plug. The plug is laterally retained in each case by a brick-holder which is continuous across the length of the door and is supported at the bottom by a further brick-holder. The back-lining in turn consists of masonry in this known plug construction.

The construction of the plug from brickwork here has a disadvantageous effect since it entails a disproportionately large effort in manual labour and excludes preheating of the brickwork in an expert fashion, which preheating is a prerequisite for pre-firing or tempering of the plug. As a result, the plug is prematurely destroyed and, accordingly, frequent renewal work is necessary. Even plugs which have been partially destroyed must here be renewed entirely.

Bricking the plug up onto the lower brick-holder and the presence of the lateral brick-holders located on the outside have the disadvantage that these components which consist of cast iron or forged iron are exposed to the direct action of the internal temperature in the oven and thus also form scale readily. Furthermore, these brick-holders represent considerable expense. In order to prevent scaling and premature destruction of the brick-holders, attempts are made to give the plug a special shape so that as little coal as possible remains between the oven wall and the plug. Recent research has, however, shown that, in the lower region of the chamber, pressures are generated which are higher by orders of magnitude than the pressures in the so-called gas collection space above the oven filling and that an equalisation of pressure does not occur. Inter alia, this leads to a discharge of gas and tar in the lower region of the door. Both these facts are disadvantageous. In particular, the tar which oozes out leads to a failure of the sealing strips.

It is also known to provide a tamping compound for the plug in place of the brickwork. The introduction of a compound of this type, however, requires shuttering in situ. This is labour-intensive and expensive. Furthermore, even in the case of a plug of this type, preheating of the door plug cannot be carried out in situ in an expert fashion. Moreover, the brick-holders are necessary. Thus, when refractory tamping compounds are used for making the plug, no significant improvement results as compared with the bricked-up plug.

In the two plug designs, the brick-holders represent an additional problem which results from the various oven types and oven sizes, which require different door dimensions. In fact, more than fifty different types of lateral brick-holders are thus required in major coal-mining concerns, and these must be held in stock.

It is the object of the invention to provide a plug which consists of ready-made components and which makes a longer life possible and no longer requires any lateral brick-holders.

According to the invention, this object is achieved when the pre-fired bricks have recesses, which each penetrate the width of the plug and the bricks, for receiving a plurality of countersunk bolts which form the fixing means and the ends of which can be screwed into bores, provided with an internal thread, in the plug side of the door, and when the lowest brick forms the support on the brick-holder and one of the subsequent bricks serves as an adaptor to adjust the height of the plug.

As a result of sub-dividing the height of the plug into individual and naturally few ready-made components which consist of a refractory compound, in particular of refractory concrete, and which have a handy size, the desired longer life is ensured, inter alia, by a manufacture which is closer to the optimum in a ready-made component works, as compared with bricking up in situ. In particular, in a ready-made component works, pre-firing can be carried out by preheating the bricks in an expert fashion. The bricks can have a height of approximately 300–600 mm with a full width of the plug. Bricks of this type can be exchanged individually if damage should have occurred.

The fixing of the bricks with the aid of the bolts is possible since the entire weight of the plug is supported on the brick-holder so that the bolts are not stressed for shear. The shank diameters can thus be relatively small. The bolts have the additional advantage that the bricks can be standardised since the fixing of the bolts in the door body is independent on the constructional components of the door, which lie on the outside, such as, for example, locks and similar devices. The same bricks can thus be used in all conventional doors which have substantially equal widths but different lengths. As a result, the prerequisites for the use of ready-made components are provided, since long runs are necessary for this purpose.

As a rule, the lowest brick differs from the other bricks since it is associated with the brick-holder. The remaining identical bricks cope with the differing heights of the doors since the height adjustment is accomplished with the brick used as an adaptor.

Preferably, and according to a further feature of the invention, the uppermost brick has a surface which forms a part of the upper end face of the plug and which extends obliquely from the outside upwards and in the direction of the door body and from which one tar discharge chute formed on each side of the plug starts, the bottom of the tar discharge chute being located in front of the associated lateral part surface converging inwards and the chutes extending over the remaining height of the plug. A particular provision in this embodiment of the invention is that the lower sections of the tar discharge chute and its end sections leading to the outside are formed in the brick adjoining the uppermost brick, one of the subsequent bricks, with the exception of the lowest brick, being shaped as a height-adjusting brick.

The result of this is that the two uppermost bricks can be of the same design for all doors, since the necessary height adjustment is accomplished by a different brick. The design of the uppermost brick or the two uppermost bricks ensures that the tar formed at the level of the gas collection space is caused to drain off in the tar discharge chutes. This tar is responsible in particular for fouling the sealing strips and for the leakages which thus result at the door. With the aid of the end sections, which lead to the outside of the plug, of the tar discharge chutes, it is fed back into the oven charge where it passes into a hotter zone where it is vaporised. In this respect, the particular advantage of the invention is that these tar discharge chutes are provided in the ready-made component works, namely in the bricks themselves, and that an in situ installation of tar discharge chutes having separate components can thus be dispensed with.

According to a further feature of the ready-made components forming the plug, the latter are designed in such a way that the short transitions adjacent to the outside of the bricks are shaped as plane longitudinal surfaces which converge outwards, and that the adjacent longitudinal surfaces are shaped to be longer but likewise converging outwards; the part surfaces which converge inwards and have a relatively large area and amount to approximately half the thickness of the brick, adjoin these longitudinal surfaces. These part surfaces end in the uppermost brick below the oblique surface and in a rectangular block adjacent thereto.

In practice, it is found that, on charging the oven chamber, the coal penetrates only between the longitudinal surfaces converging outwards and the longitudinal surfaces which are adjacent thereto and likewise converge outwards, and up to the chamber walls adjoining thereto, and then jams. For this reason, free lateral spaces remain, which are located between the oven door or the frame parts adjacent thereto, the part surfaces which converge inwards and have a relatively large area, and the chamber walls on either side of the plug and which form channels which are continuous from the bottom to the top and end at the rectangular block. The pressure equalisation between the relatively low pressure level in the gas collection space and the considerably higher pressure level at the floor of the oven can take place through these channels. The difficulties which were hitherto caused by the lack of pressure equalisation, as discussed at the outset, are eliminated in this way.

The rectangular block which has been mentioned, is located at the top and forms a unit which the remaining parts of the upper brick, makes it impossible for coal to drop from above into the pressure equalisation channels mentioned, during the levelling procedure. For this reason, the channels remain free even under the influence of the action of the levelling rod on the oven charge and they can thus fulfil their purpose for the duration of the entire carbonisation time.

The ready-made components forming the novel plugs do not absolutely have to be joined to one another. According to a preferred feature of the invention, however, it is envisaged to provide the transversely running joints between the bricks with a refractory lining and a filling covering the outside of the latter, a groove being provided for the filling, which groove has a boundary surface next to the bottom and a lateral boundary surface adjacent thereto, which encloses an acute angle with the bottom. Preferably, this lining consists of a felt comprising refractory rock material, and this felt can also be used for the heat-insulating back-lining mentioned above. The filling can consist of a refractory mortar.

On the one hand, the lining ensures a perfect support of the bricks on one another without edge compression and, on the other hand, the lining prevents the penetration of hydrocarbons between the ready-made components. The filling serves to prevent the penetration of tar into the joints between the ready-made components.

As a result of being manufactured in a ready-made components works, the ready-made components can also be provided with special properties which cannot be realised in masonry bricks. These include above all a higher heat insulation. This is achieved, according to a further feature of the invention, by bricks which have a porous core and a liquid-tight and gas-tight shell around the core. The porosity of the core leads to the increased heat insulation. The shell prevents the penetration of hydrocarbons into the pores.

Finally, the invention makes it possible also to remove the lower brick-holder from the immediate zone of action of the oven heat and hence to attain a longer life. This is achieved when the lowest brick has a recess, by means of which the brick-holder is countersunk in the brick.

Figure 3:
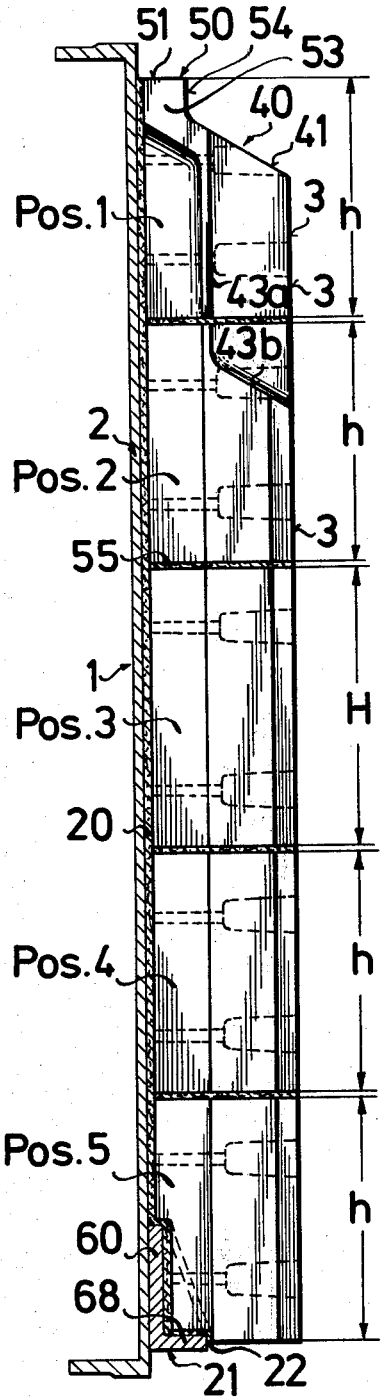
Figure 2:
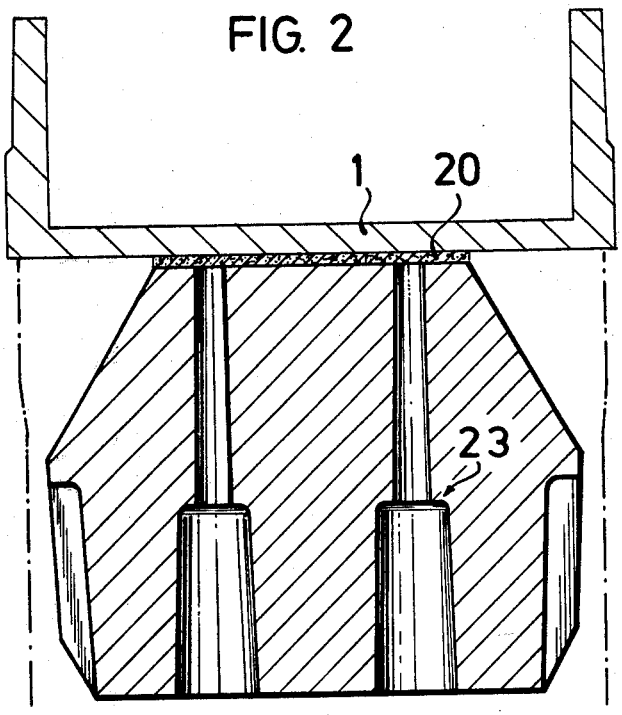
Figure 4:
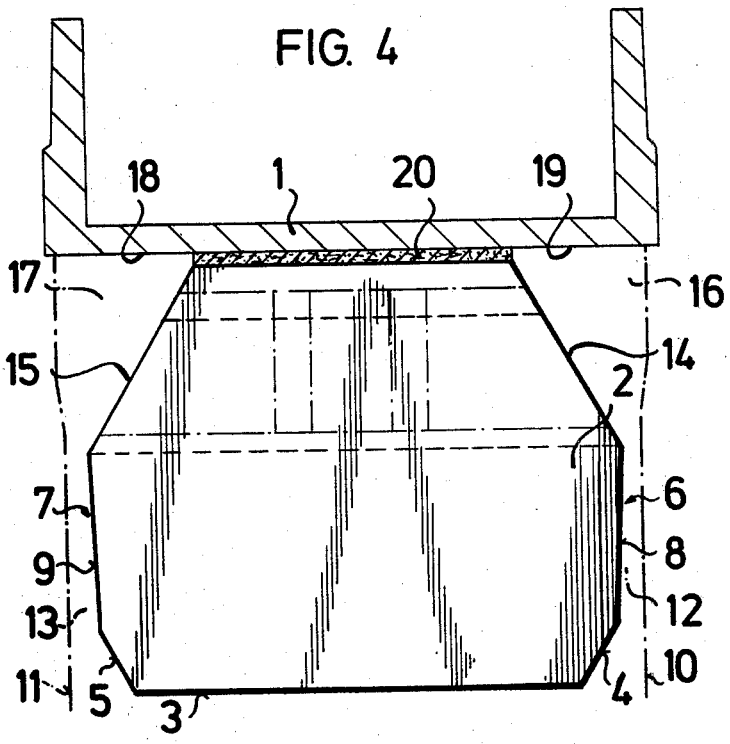
Figure 5:
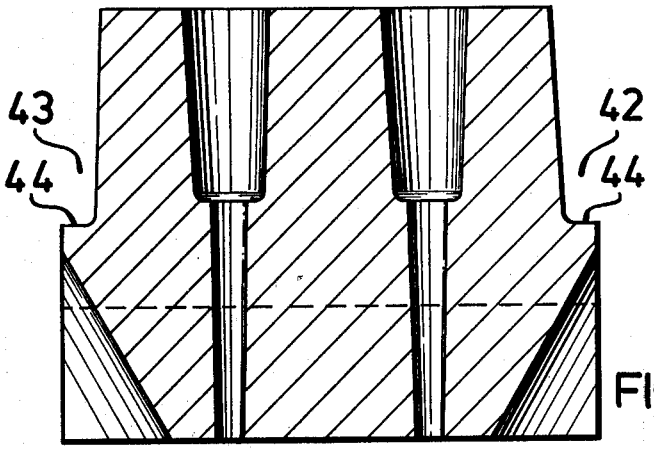
Figure 6:
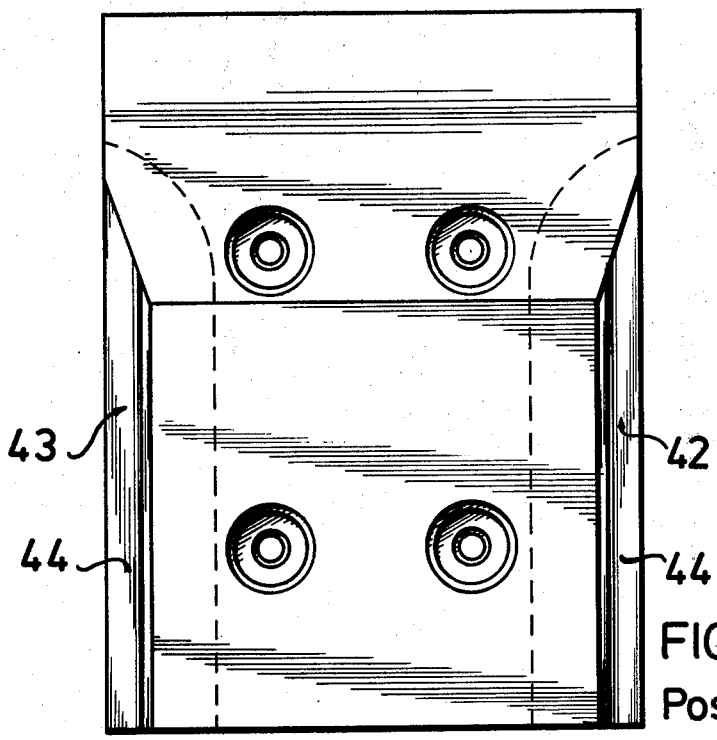
Figure 7:
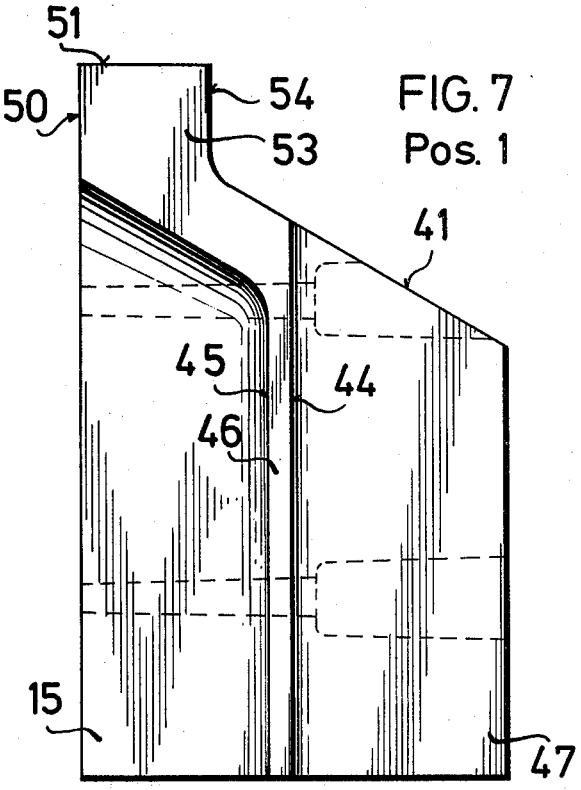
Figure 8:
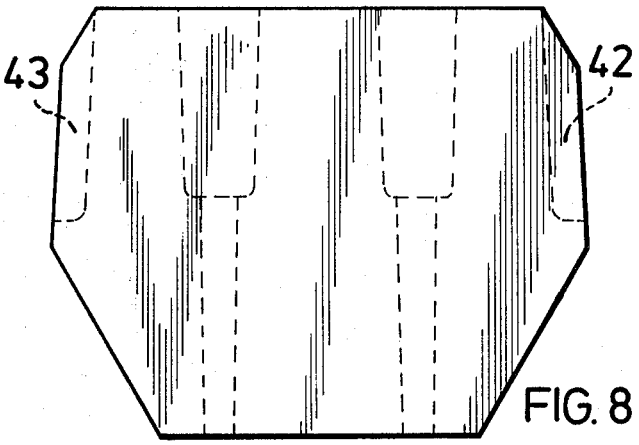
Figure 10:
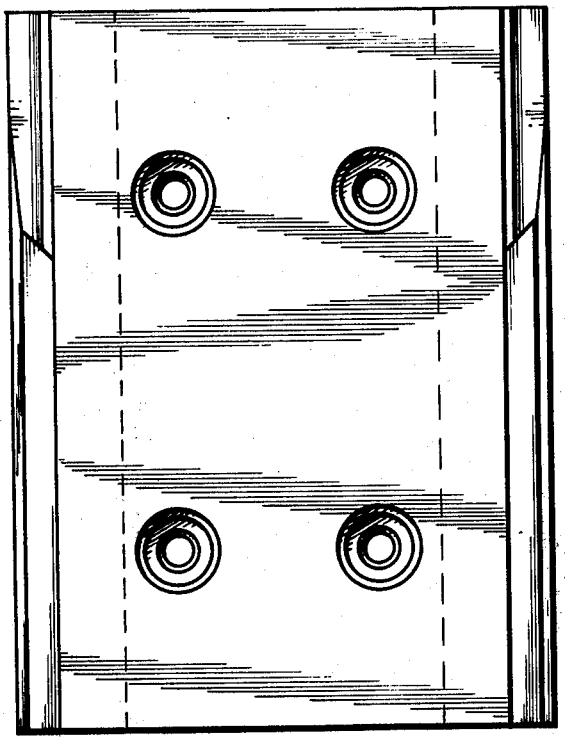
Figure 9:
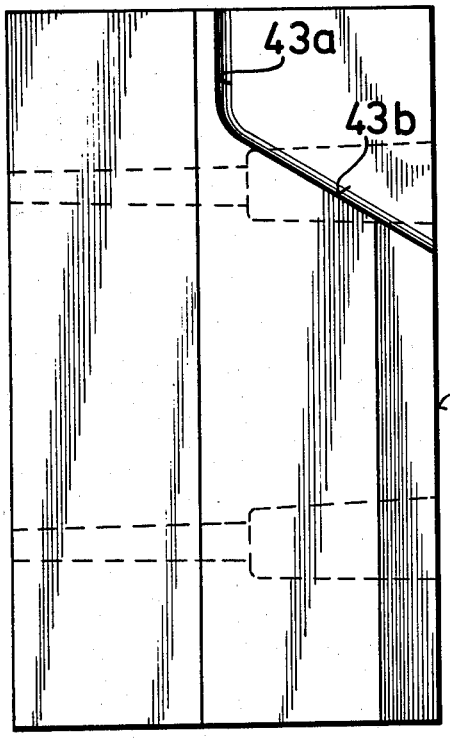
Figure 11:
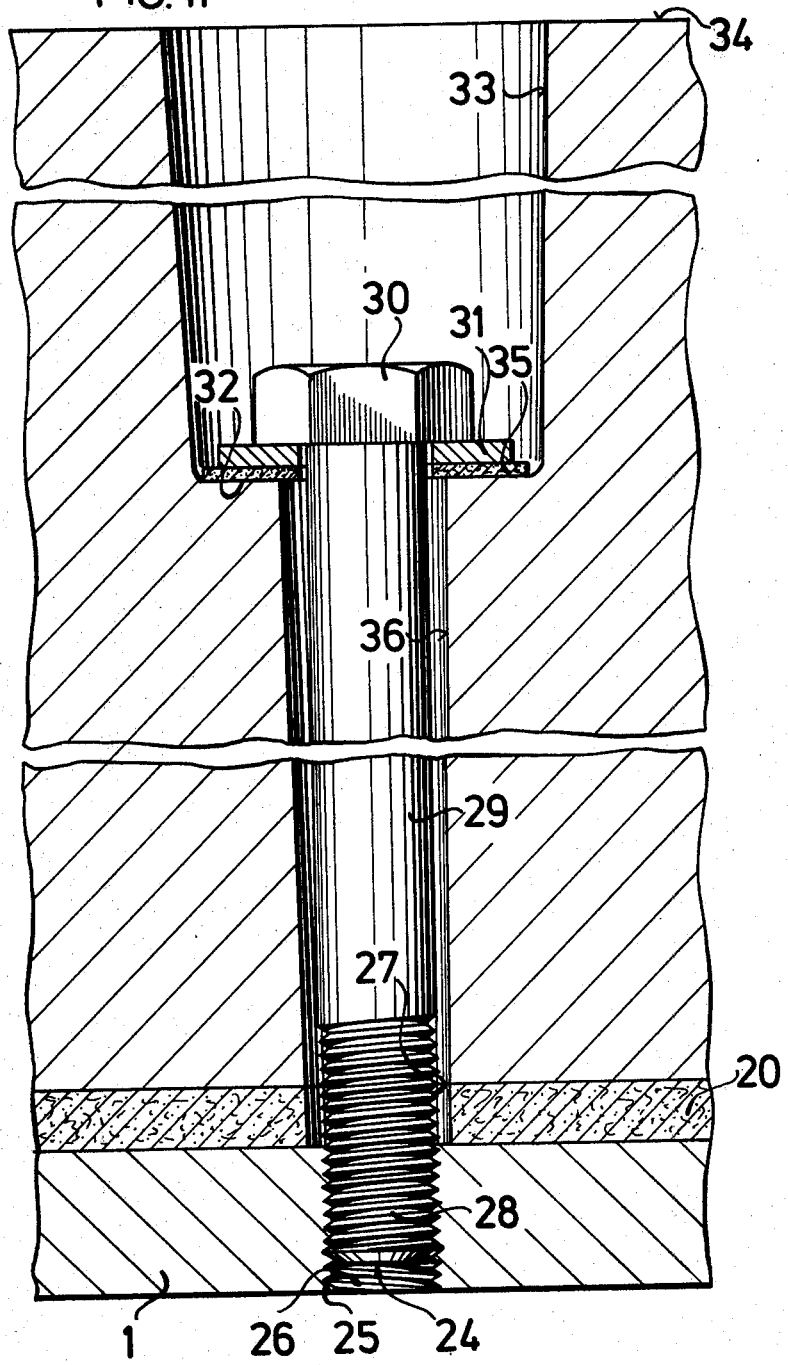
Figure 12:
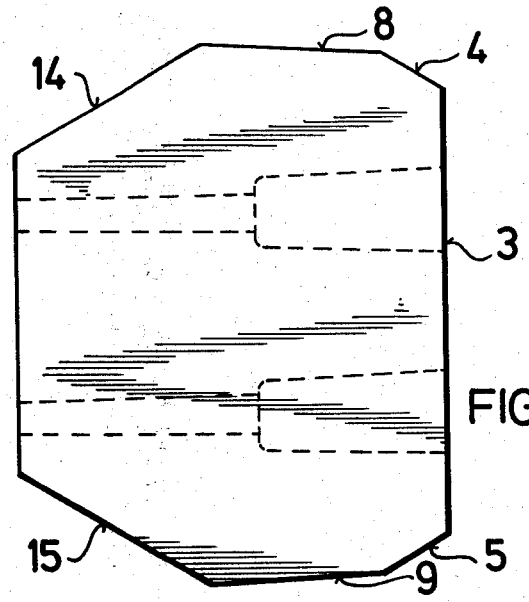
Figure 13:
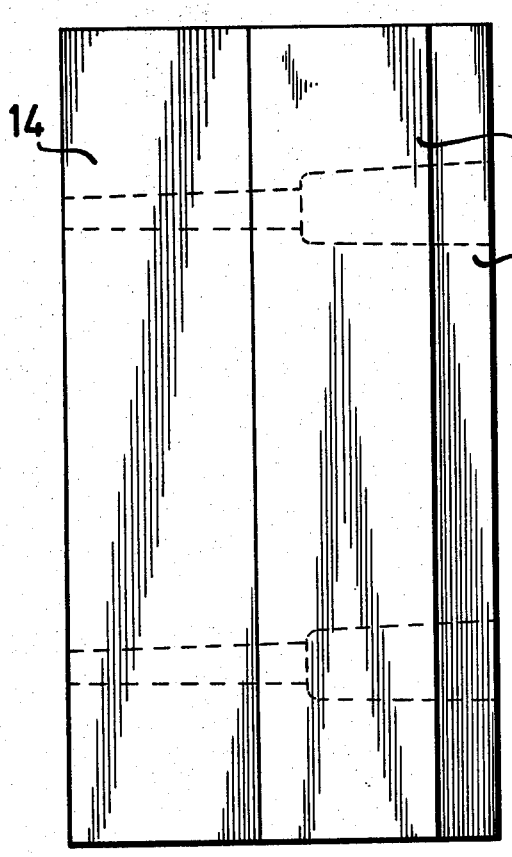
Figure 15:
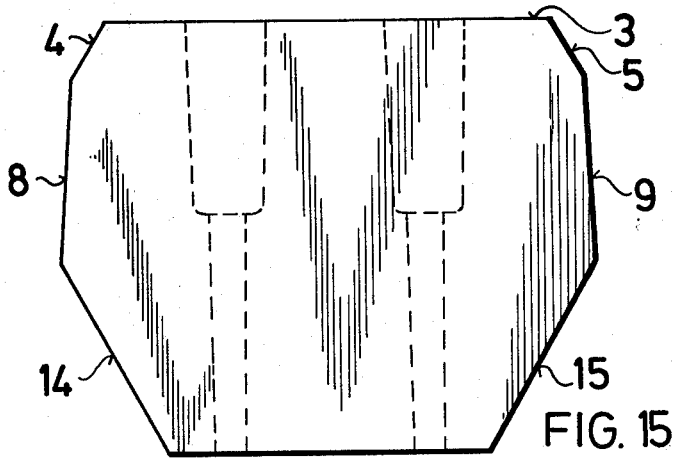
Figure 14:
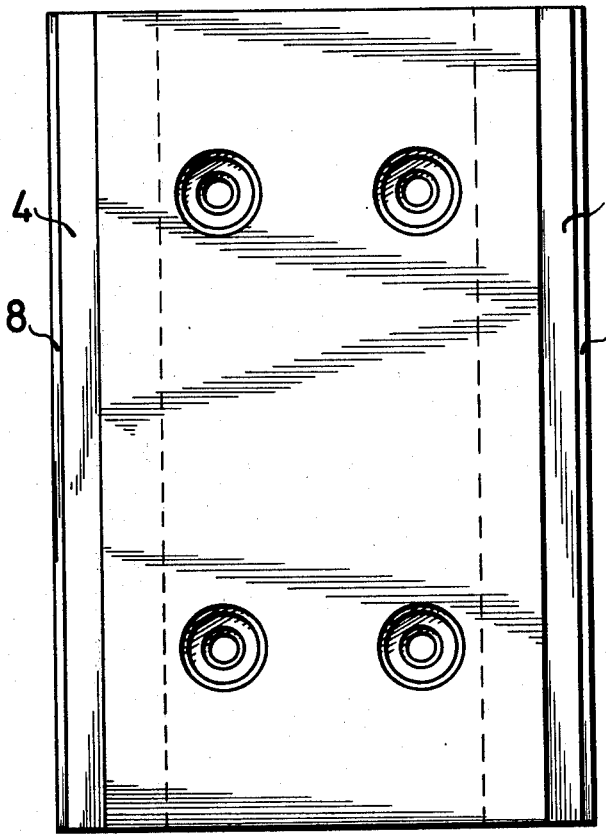
Figure 16:
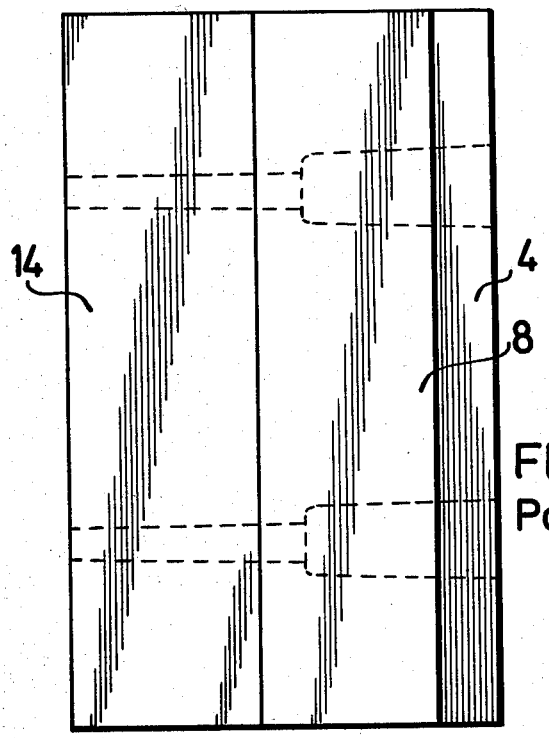
Figure 17:
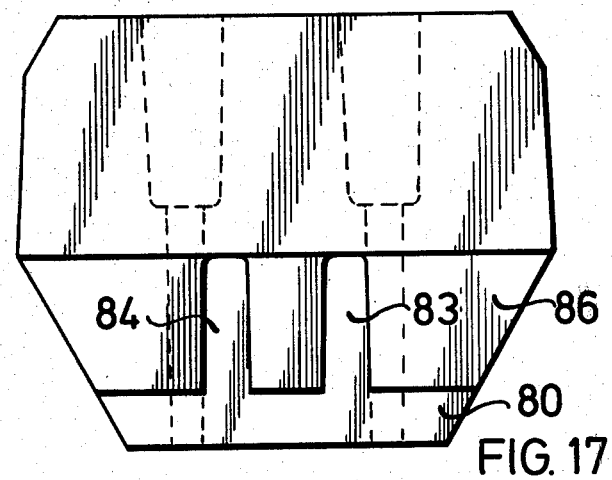
Figure 19:
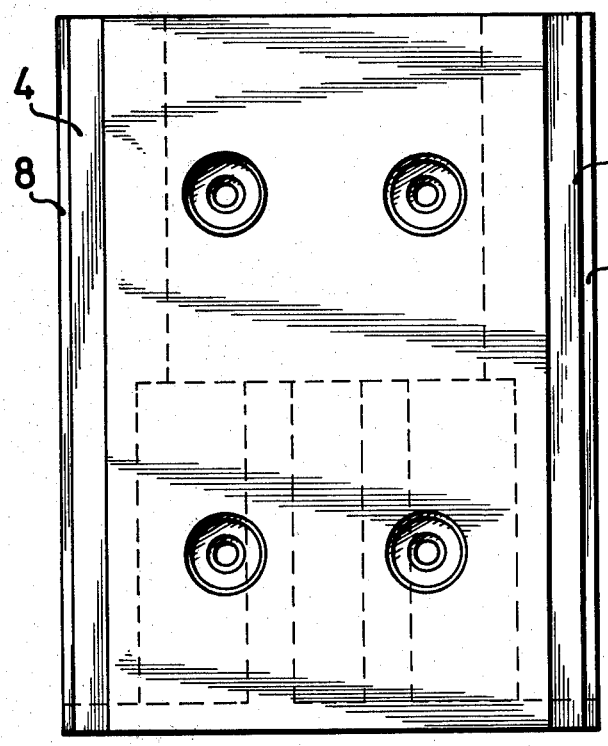
Figure 18:
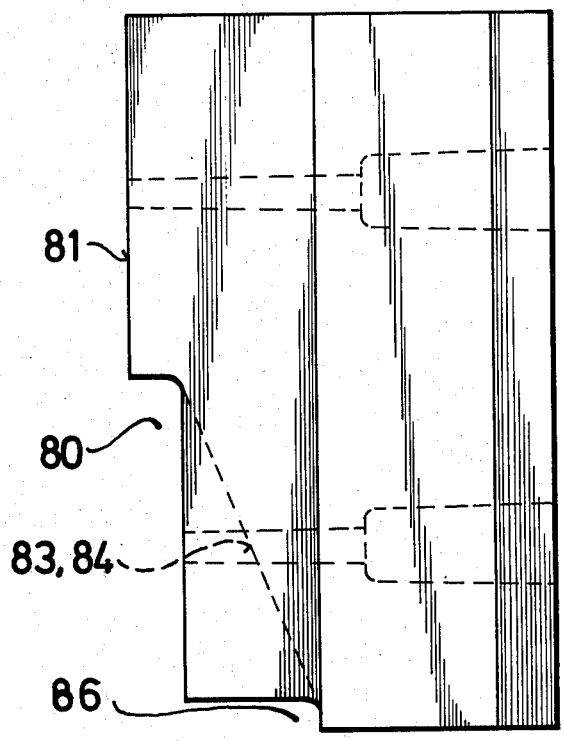
Figure 20:
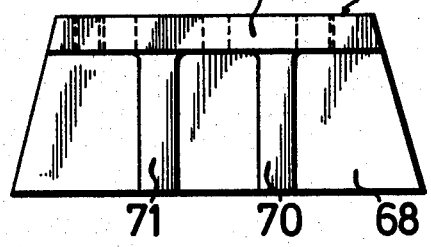
Figure 21:
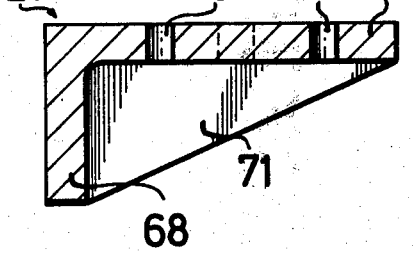
Figure 22:
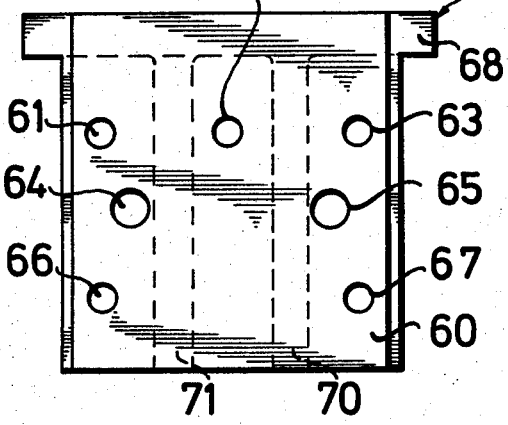

The details, further features and other advantages can be seen from the description which follows of an embodiment, by reference to the figures in the drawing in which FIG. 1 shows a view, of a coke-oven chamber door, onto the outside of the plug, the details of the door being omitted as far as they are not necessary for understanding the invention, FIG. 2 shows the subject of FIG. 1 in cross-section and in plan view, FIG. 3 shows a side view of the subject of FIG. 1, the ready-made components being designated as position (Pos.) 1 to position 5, FIG. 4 shows a plan view of the subject of FIG. 3, FIG. 5 shows a section through the ready-made component according to position 1, FIG. 6 shows a view of the ready-made component reproduced in FIG. 5, FIG. 7 shows a side view of the ready-made component reproduced in FIGS. 5 and 6, FIG. 8 shows a view of the ready-made component according to position 2 from below, in a representation corresponding to FIG. 5, FIG. 9 shows the ready-made component according to FIG. 8, in a representation corresponding to FIG. 7, FIG. 10 shows the ready-made component according to FIGS. 8 and 9 in a representation corresponding to FIG. 6, FIG. 11 shows, diagrammatically and in cross-section, one of the fixing means for mounting the ready-made components according to positions 1–5, FIG. 12 shows the ready-made component according to position 3 in a representation corresponding to FIG. 8, FIG. 13 shows the ready-made component according to FIG. 12 in a representation corresponding to FIG. 9, FIG. 14 shows the ready-made component according to FIGS. 12 and 13 in a representation corresponding to FIG. 10, FIG. 15 shows the ready-made component according to position 4 in a representation corresponding to FIG. 12, FIG. 16 shows the ready-made component according to FIG. 15 in a representation corresponding to FIG. 13, FIG. 17 shows the ready-made component according to position 5 in a view from below, FIG. 18 shows the ready-made component according to FIG. 17 in a representation corresponding to FIGS. 7, 9, 13 and 16, FIG. 19 shows the ready-made component according to FIGS. 17 and 18 in a representation corresponding to FIGS. 6, 10 and 14, FIG. 20 shows, in a view from below, the brick-holder for supporting the plug, FIG. 21 shows the subject according to FIGS. 20 and 22 in section and in side view, and FIG. 22 shows a view of the subject according to FIG. 20.

The ready-made components, which are designated by the position numerals 1–5, conjointly form a plug which protects the oven door, which is generally designated as 1 and which preferably consists of cast iron, of a coke-oven chamber against the actions of the internal temperature in the oven. As can be seen in particular from the representation of FIG. 4, the plug which is generally designated as 2, has a continuous plane outside 3 and relatively short transitions 4 and 5 in its longitudinal sides generally designated as 6 and 7. The short transitions 4 and 5 adjoing the outside 3 are shaped as plane longitudinal surfaces. These surfaces converge outwards. The adjacent longitudinal surfaces 8 and 9 are longer, but likewise converge outwards; however, the angle is considerably smaller than in the case of the surfaces 4 and 5 which converge outwards. Between the chamber walls indicated at 10 and 11, an interspace 12 or 13 is thus formed, which narrows from the interior of the oven on either side of the plug. The two spaces 12 and 13 are continuous from the top to the bottom and are partially filled when the coal is charged.

The part surfaces 8 and 9 are adjoined by part surfaces 14 and 15 respectively, which converge inwards and the width of which amounts to approximately half the thickness of the brick. The angle by which these surfaces 14 and 15 converge inwards is very large, and in any case it is larger than the angle by which the part surfaces 8 and 9 converge outwards and it is also larger than the angle by which the part surfaces 4 and 5 converge outwards.

As a result of this design, one channel 16 or 17, respectively, is formed on each side of the plug between the chamber walls 10 and 11, which channel is delimited on one side by the coal charged, which banks up as described, and the chamber walls 10, 11 and is delimited on the other side by the surfaces 14 and 15 as well as the surfaces 18 or 19 of the door body, which remain free. The importance of this channel will be further discussed below.

The plug 2 is built up from refractory bricks which represent voluminous ready-made components. The ready-made components are designated as position 1–position 5. With the aid of fixing means, which are yet to be explained further below, they are mounted, together with a back-lining 20 (compare FIGS. 2–4) of heat-insulating material, on the inside of the door body 1 which preferably consists of cast iron. Moreover, the plug is supported at the bottom on a brick-holder 21, the design of which will yet be further explained below in conjunction with FIGS. 17–21. Heat-insulating material is likewise located at 22 between the brick-holder 21 and the ready-made component according to position 5.

As can be seen from the representation of FIG. 1, the ready-made components according to position 1–position 5 have the width of the plug. According to the illustrative embodiment shown, they each possess four recesses which are in turn of identical design so that it suffices to explain the shape of the recess, which is generally designated as 23 (FIG. 2), in more detail by reference to FIG. 11. The bolts 24 (FIG. 11) which are associated with each recess 23 and which together form the fixing means of the plug 2 are likewise identical.

As can be seen from FIG. 11, the door leaf 1 has, at each of the points aligned with the recesses 23 in the ready-made components, one bore 25 which can also be made as a blind bore but which is continuous according to the illustrative embodiment of FIG. 11. At 26, the bore is provided with an internal thread so that the end part 28, which is provided with an external thread 27, of the bolt shank 29 can be turned in. The shank of the bolt 29 carries a hexagon head 30 which is supported on a disc 31, a disc 35 being placed between the disc 31 and the bottom 32 of a depression 33 in the top side 34 of the particular ready-made component. Like the back-lining 20 of the ready-made components, the disc 35 consists of a felt of refractory rock wool. Of course, other refractory materials can also be considered for this purpose as long as they put up sufficient resistance to the high oven temperatures.

The sunk part 33 serving to countersink the bolt head 30 continues in a cylindrical recess 36 which receives the bolt shank 29 with a clearance. This makes it clear that the bolt 24 itself is not stressed in shear but only in tension. The reason for this is that the entire weight of the plug is supported on the brick-holder 21 which has been mentioned.

In the illustrative embodiments drawn in FIGS. 1 to 4, the height h is about 600 mm and is identical for the ready-made components according to positions 1 and 2 as well as 4 and 5. The remaining height of the plug is adjusted by means of the ready-made component according to position 3, which has a height H of about 684 mm in the illustrative embodiment shown. It can be seen that, as a result of this, the ready-made components according to positions 1 and 2 as well as 4 and 5 can have an identical shape for all door heights. This is particularly important since the shaping of the ready-made components according to positions 1 and 2 as well as that according to position 5 differs from the remaining ready-made components according to position 4.

In the case of the ready-made component according to position 1, this results on the one hand from a particular design of the upper oblique surface, generally designated as 40, of the ready-made component according to position 1 and hence of the plug 2. A surface 41 which extends obliquely upwards from the outside 3 of the ready-made component and in the direction of the door body forms a part of this upper end face 40. Essentially, this surface serves to ensure that the door fits into the door frame and to prevent jamming of coal at this point. However, a tar discharge chute 42 or 43 starts on each side from this surface 41. These tar discharge chutes are delimited by only two brick surfaces. On one side, this is the chute bottom 44 which is formed by a relatively narrow strip-like widening 45 starting from the oblique surface 41 and which ends at the outer surface 46 thereof (FIG. 7). On the other side, the tar discharge chute 42 or 43 is delimited by one of the surfaces 47 extending perpendicular thereto. However, the tar discharge chute is given such a length according to the illustrative embodiment shown that the ready-made component position 2 which adjoins the ready-made component according to position 1 also carries a part of the tar discharge chutes 42 and 43. As can be seen in this respect from the representation of FIGS. 1 and 3 and the representation of the ready-made component according to position 2 in FIGS. 8 to 10, the lower section 43*a*, extending in a straight line, of the tar discharge chute 43, which has a transition into an end section 43*b*, is formed in the upper part of this ready-made component. This end section 43*b* ends on the outside 3 of the ready-made component according to position 2. As a result of this, the tar which is formed immediately below the gas collection space can drain off through the two chutes 42 and 43 of identical shape and it is led away into a lower zone which is located below the gas collection space and which is hotter and in which the collected tar vaporises as a consequence.

On the other hand, as can be seen from FIGS. 1 and 3 as well as 5 to 7, the pressure equilisation channels 16 and 17 which have been mentioned are closed at the top as a result of the special design of the ready-made component according to position 1. Although the surfaces 14 and 15 which converge inwards are also formed in the lower part of the ready-made component according to position 1, they end in a rectangular upper block 50 which forms a unit together with the remaining parts of the ready-made component according to position 1. The rectangular upper block 50 has a part surface 51 which extends orthogonally to the plane of the door body 1, two side surfaces 52, 53 and an outer surface 54 which reaches up to the oblique surface 41 and extends substantially parallel to the plane of the door. As a result, the rectangular body forming the block 50 can prevent the penetration of coal into the channels 16 and 17 which accordingly remain free and thus lead from the bottom of the chamber right up to the upper limit of the plug.

A pressure equalisation between the relatively low pressure in the upper gas collection space and the pressure, which is higher by orders of magnitude, in the lower chamber zone takes place in these channels 16 and 17. As a result of this, the door 1 is relieved by these channels, and in particular its sealing devices which cooperate with the door frame which is not shown, are relieved.

The transversely running joints between the bricks are in turn provided with a refractory lining, one of which is shown at 55 in FIG. 3. A supplementary lining, for which an undercut groove can be provided on the outside 3 of the ready-made components, is not shown. Accordingly, the groove comprises a plane bottom and, in each of the adjacent ready-made components, half a plane bottom and a lateral boundary surface which adjoins the latter and encloses an acute angle with the bottom so that the filling consisting of refractory mortar is retained in the groove.

An embodiment of the invention, in which the ready-made components according to position 1–position 5 are provided with a porous core and a liquid-tight and gas-tight shell around the core, is likewise not shown.

The design of the brick-holder which takes the weight of the plug 2 and accordingly relieves the bolts 24 of the weight, can be seen particularly from FIGS. 20 to 22. This is a body which consists of cast iron and has a base plate 60 which contains several bores 61–67. With the aid of these bores, the brick-holder 21 can be mounted on the door body by means of bolts. As can be seen in particular from FIG. 21, the base plate 60 forms a unit with a support plate 68 extending orthogonally. For this reason, the support plate 68 can transfer the weight of the plug 2 to the plate 60 and hence to the fixing means. According to the illustrative embodiment, two gusset plates 70 or 71 which likewise form a unit with the other parts of the brick-holder, serve to improve the dimensional rigidity of the brick-holder 21.

Accordingly, the ready-made component according to position 5 has a recess 80 in its rear side 81 so that it can receive the plate 60 of the brick-holder 21, taking into account the back-lining 22. Recesses 83 and 84 for the said gusset plates 70 and 71 which accordingly are covered by refractory material of the ready-made component according to position 5 in the same way as the plate 68 which is accommodated in a further recess 86, start from the recess 80. As a result of this, scaling of the brick-holder is effectively countered.

We claim:

1. A plug for protecting a coke-oven chamber door from heat within the oven, said plug comprising a plurality of vertically stacked refractory bricks mountable on the inside of said door: said bricks having first and second spaced, parallel vertical faces, said second face being abutable with said door and said first face facing away from said door; said faces being joined by side walls, said side walls including short transition portions joined to said first face and converging in a direction away from said door, said side walls having adjacent portions joined to said transition portions, said adjacent portions being longer than said transition portions and converging in a direction away from said door but at a smaller angle than said transition portions, said side walls further including diverging portions joined to said adjacent portions and to said second face, said diverging portions diverging in a direction away from said door, the uppermost brick in said stack having a surface intersecting said first face and side walls which forms a part of the upper end face of the plug and which extends obliquely upward from said first face in a direction toward the door; said diverging portions of said side walls ending below the intersection of said oblique surface and said first face, said plug having a downwardly extending tar discharge chute formed in each side wall of said plug; the lowermost brick in said stack being supportable on said door; the height of an intermediate one of said bricks being selected in accordance with the desired height of said plug; and said bricks having recesses therein receiving a plurality of countersunk bolts extending through said bricks and engageable with said door for fastening said bricks to the door.

2. The plug according to claim 1 wherein said tar discharge chute in each side wall of said plug commence at said oblique surface, are located adjacent said first face on said side walls of said uppermost brick, and extend downwardly along the side walls of said uppermost brick.

3. A plug according to claim 2 wherein said tar discharge chutes terminate in the brick next below the uppermost brick, another of said intermediate bricks other than the uppermost brick, next uppermost brick, and lowermost brick being formed as a height adjusting brick.

4. A plug according to claim 1 wherein said diverging portions of said side walls comprise approximately one half the length of said side walls.

5. A plug according to claim 1 wherein a refractory lining and filling are provided for each of the transversely running joints between the bricks.

6. A plug according to claim 5 characterized in that the lining comprises a packing formed of refractory rock material and the filling comprises a refractory motar.

7. A plug according to claim 1 wherein the bricks have a porous core and a liquid-tight and gas-tight shell around the core.

8. A plug according to claim 1 wherein the lowermost brick in the stack has recess means by which a brick-holder on said door mates with the brick.

9. A plug according to claim 8 wherein said brick holder has a plate with gussets extending therefrom and wherein the recess means formed in the lowermost brick comprises first recess means for the gussets and second recess means for the plate, said first and second recess means being mutually orthogonally arranged.

10. A plug according to claim 1 wherein the bolt receiving recesses receive the head of the bolt, a washer, and a heat insulating packing, said recess having a cylindrical bore which surrounds the shank of the bolt, said recesses being sealable from the outside by refractory material.

11. A plug according to claim 10 wherein the recesses are filled with refractory motar.

12. A plug according to claim 1 wherein said recesses extend through the central portions of said bricks.

* * * * *

UNITED STATES PATENT AND TRADEMARK OFFICE

CERTIFICATE OF CORRECTION

PATENT NO. : 4,231,846

DATED : November 4, 1980

INVENTOR(S) : Hans Mathiak et al

It is certified that error appears in the above-identified patent and that said Letters Patent are hereby corrected as shown below:

Column 2, Line 51, Cancel "lengths" and substitute therefor ---heights---

Column 3, Line 58, Cancel "which" and substitute therefor ---with---

Column 5, Line 36, Cancel "adjoing" and substitute therefor ---adjoining---

Column 9, Line 17, Cancel "motar" and substitute therefor ---mortar---

Column 10, Line 17, Cancel "motar" and substitute therefor ---mortar---

Signed and Sealed this

*Twenty-eighth* Day of *April 1981*

[SEAL]

*Attest:*

RENE D. TEGTMEYER

*Attesting Officer*

*Acting Commissioner of Patents and Trademarks*